United States Patent [19]

Mullins

[11] 4,093,309

[45] June 6, 1978

[54] METHOD OF AND APPARATUS FOR CONTROLLING ADVANCE OF UNDERGROUND ARMORED CONVEYORS

[75] Inventor: Rex Mullins, Burton upon Trent, England

[73] Assignee: Coal Industry (Patents) Ltd., London, England

[21] Appl. No.: 768,438

[22] Filed: Feb. 14, 1977

Related U.S. Application Data

[63] Continuation-in-part of Ser. No. 605,837, Aug. 19, 1975, abandoned.

[30] Foreign Application Priority Data

Oct. 24, 1974 United Kingdom ..... 45996/74

[51] Int. Cl.[2] ..... E21D 15/48

[52] U.S. Cl. ..... 299/1; 33/125 R; 73/21

[58] Field of Search ..... 173/21; 299/1, 11; 33/125 R, 129 R

[56] References Cited

U.S. PATENT DOCUMENTS

| | | | |
|---|---|---|---|
| 3,248,794 | 5/1966 | Corry | 33/125 R |
| 3,322,465 | 5/1967 | Crom et al. | 299/1 |
| 3,531,159 | 9/1970 | Schmidt | 299/1 |
| 3,812,589 | 5/1974 | Schutheis | 33/129 X |

FOREIGN PATENT DOCUMENTS

| | | | |
|---|---|---|---|
| 1,222,003 | 8/1966 | Germany | 299/1 |
| 1,109,836 | 4/1968 | United Kingdom | 299/1 |

*Primary Examiner*—Ernest R. Purser
*Assistant Examiner*—William F. Pate, III
*Attorney, Agent, or Firm*—Stevens, Davis, Miller & Mosher

[57] ABSTRACT

In controlling advance of an armoured conveyor in an underground mine, detector means detect the advance of different conveyor sections and control means control current and/or subsequent advances of the conveyor in relation to the detected advances.

3 Claims, 2 Drawing Figures

METHOD OF AND APPARATUS FOR CONTROLLING ADVANCE OF UNDERGROUND ARMORED CONVEYORS

This is a continuation of application Ser. No. 605,837 filed Aug. 19, 1975, now abandoned.

This invention relates to a method of and apparatus for controlling advance of underground armored conveyors.

In longwall mining it is usual to have a longwall working face provided with an armored conveyor extending along the length of the working face, the conveyor providing guidance for a mineral mining machine arranged to win mineral from the working face as it is guided by the conveyor along the working face.

Typically the armored conveyor is advanced towards the working face by a series of advancing rams arranged spaced along the conveyor. Once the conveyor is fully advanced towards the working face the advancing rams may operate to continuously urge the conveyor towards the working face so that as the mining machine (usually a plow type machine) traverses along the working face it is urged into the mineral in a direction normal to the traversing direction. With uncontrolled operation of the advancing rams the conveyor track tends not to remain straight, some sections of the conveyor being in advance of other sections. One prior proposed method of controlling advance of an armored face conveyor, which is continuously urged towards the working face, included simultaneously applying the same fluid pressure to all the advancing rams, the value of the fluid pressure being controlled in dependence on the advance of the conveyor at the point along the conveyor reached by the mining machine in relation to the advance of the remainder of the conveyor. Prior proposed apparatus for carrying out the above prior method comprised displacement pickups for simultaneously measuring the advance of different points of the conveyor, monitoring means connected to the pickups and permanently operable to compare the information supplied by the pickups and to determine the amplitude of the relative difference existing between the advance of the point of the conveyor reached by the mining machine and the advance of the remainder of the conveyor, and regulating means operable to adjust the value of the fluid pressure applied to all the advancing rams in dependence on the amplitude of this relative difference.

Alternatively, once the conveyor is fully advanced towards the working face the advancing rams may be made inoperative or may operate to retain the conveyor in a set position relative to the working face until after the mining machine (for example a shearer) has passed. Thus, the mining machine is not urged into the mineral in a direction normal to the traversing direction.

The present invention relates particularly to longwall mining installations adopting the latter mentioned operational procedure for advancing the conveyor.

An object of the present invention is to provide a method of and apparatus for controlling advance of an armored conveyor which tends to overcome or reduce conveyor misalignment.

According to one aspect of the present invention a method of controlling advance of an armored conveyor in an underground mine comprises advancing the conveyor toward a desired advanced position, detecting the advance of different sections of the conveyor and controlling the current and/or subsequent advances of the conveyor sections in relation to the detected advances.

According to another aspect of the present invention apparatus for controlling advance of an armored conveyor in an underground mine comprises advancing the conveyor toward a desired advanced position, detecting the advance of different sections of the conveyor and controlling the current and/or subsequent advances of the conveyor sections in relation to the detected advances.

According to another aspect of the present invention apparatus for controlling advance of an armored conveyor comprises detector means for detecting the advance of different sections of the conveyor and for deriving signal means indicative of the detected advance of each of the sensed sections, receiver means for receiving the signal means, and control means for controlling the current and/or subsequent incremental advances of each section of the conveyor in response to the derived signal means received by the receiver means.

Preferably, the detector means comprises a number of mechanisms including a wound elongated member which in use is anchorable at one end to unwind as the conveyor is advanced, the signal means being indicative of the unwound length of the member.

Alternatively, the detector means comprises a number of anchorable elongated members arrangeable to detect each conveyor advance, the signal means being indicative of each conveyor advance.

Advantageously, the receiver means is adapted to add successive signals received from the detector means to determine the total or accumlative advance of each conveyor section from an original base line.

Preferably, the control means comprises a series of solenoid valves.

By way of example only, one embodiment of the present invention and using the method thereof will be described with reference to the accompanying drawings in which.

Figure 2:
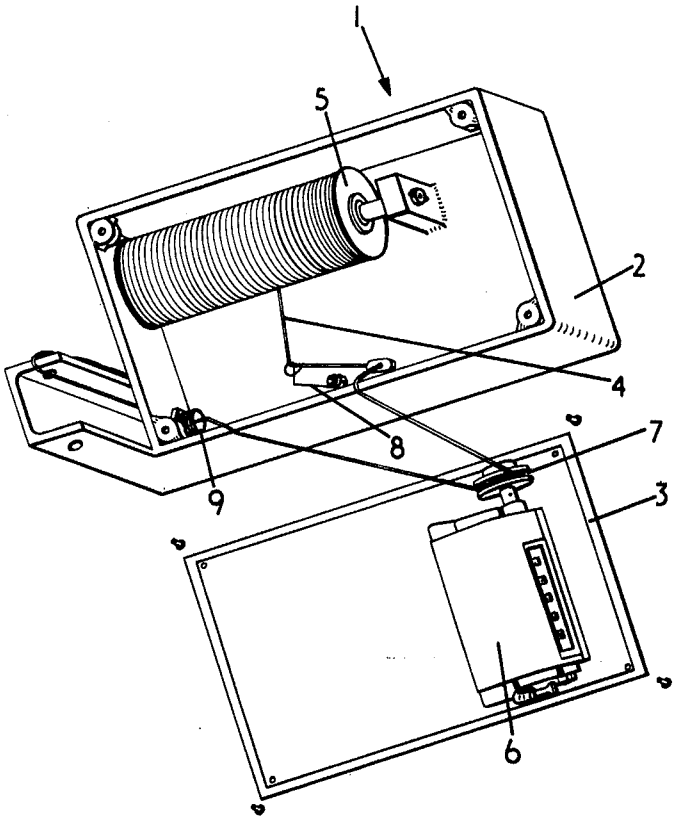
FIG. 2 is a plan of a mechanism constituting a part of detector means for detecting the advance of a conveyor section, the lid of the mechanism being shown open.

In longwall mining it is usual to have an elongated working face extending in a mineral seam (for example a coal seam) and for an armored conveyor to extend along the length of the working face adjacent to the working face. The conveyor provides guidance for a mineral mining machine (for example a well known shearer type mining machine) which traverses to and fro along the conveyor winning strips of mineral from the working face on each traverse of the working face. After mineral has been won from the working face adjacent to a conveyor section the section is advanced by a desired increment toward a desired advanced position adjacent to the working face ready for the next traverse of the machine.

The conveyor is advanced towards the working face in a well known "snake-like" manner by a series of hydraulic advancing rams spaced along the goaf side of the conveyor. Typically, on a working face having a length of 220 meters approximately 50 advancing rams are used to advance the conveyor.

Referring now to the drawings, the present invention provides a method of and apparatus for controlling incremental advance of the conveyor such that misalignment of the conveyor sections arising from non uniformity of the conveyor sections throughout the length of the conveyor tends to be reduced. The present invention comprises detector means or detecting advance of the conveyor constituted by a plurality of mechanisms 1 arranged along the goaf side of the conveyor. Typically, the mechanisms 1 are located adjacent to the advancing rams, respectively. Alternatively a mechanism 1 is located intermediate two adjacent advancing rams.

Each mechanism 1 comprises a housing 2 which in use is bolted to an adjacent conveyor section and which in FIG. 2 is shown with the lid 3 open. Within the housing 2 is located a wound elongated flexible member constituted by a cord 4 wound on a rotatable spool 5. The housing 2 also contains an impulse generating device 6 having a rotatable pulley 7 around which the cord is drivably engaged. The cord passes from the spool 5 to spring tensioning means 8 and then around the pulley 7 before passing through an opening 9. In use, the unwound end of the cord 4 which projects from the housing 1 is anchored at a location on the goaf side of the conveyor so that as the adjacent conveyor section advances the cord is unwound from the spool 5 rotating the pulley 7 to activate the impulse generating device 6 which generates impulse signals indicative of the conveyor section advance. Initially the conveyor is set along a base line with the ends of all the cords 4 firmly anchored.

Figure 1:
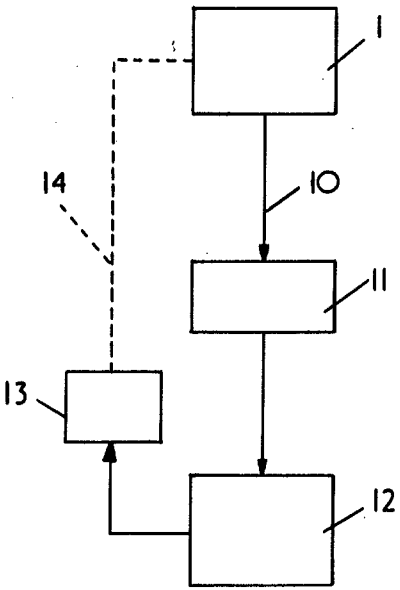
FIG. 1 is a block circuit diagram showing signal paths.

The impulse signals from all the mechanisms 1 constituting the detecting means are conveyed along paths 10 (one of which is shown in FIG. 1) along the working face to receiver means 11 positioned adjacent one end of the working face. The receiver means 11 receives the impulse signals from all the mechanisms 1 and actuates control means 12 to ensure that none of the conveyor sections is advanced beyond a desired pre-selected increment. In addition, the receiver means 11 compares all the summed received impulse signals and correspondingly actuates the control means 12 on the current incremental advance and/or on subsequent incremental advances to ensure any disparity between the summed received signals does not exceed a preselected value. Thus, all the conveyor sections tend to be maintained at the same distance from the initial base line and the straightness of the conveyor is maintained within acceptable operational limits.

The receiver means 11 further compares the sums of the impulse signals received from the two mechanisms 1 located adjacent the ends of the working face and actuates the control means 12 to ensure any disparity between these two summed signals is maintained within an acceptable limit. Thus, the two ends of the conveyor are maintained within preselected limits from the original base line. This ensures the angle of the working face with respect to roadways formed adjacent to the ends of the working face is maintained within preselected limits. Typically, the working face is substantially normal to the roadways.

The control means 12 comprises a series of solenoid valves associated with the advancing rams, respectively and each actuated by a signal received from the receiver means 11 to control the feed of fluid pressure to the associated advancing rams (indicated at 13 in FIG. 1) to ensure the ram extends the desired increment. In use, a signal from the receiver means 11 actuates one or more of the solenoid valves to extend the advancing rams 13 and thereby, advance the associated sections of the conveyor the desired increment. As the conveyor sections are advanced the associated mechanisms 1 of detector means detect the advance (indicated by the broken line path 14 in FIG. 1) and feed impulsive signals to the reciever means 11 indicating the advance. Once a conveyor section is advanced the desired increment determined by the receiver means 11 the associated solenoid valve is actuated by a signal from the receiver means to stop further advance. Thus, the receiver means 11 maintains a constant surveillance of the position of the conveyor from the original base line. Consequently, the straightness of the conveyor can be maintained within acceptable operation limits.

In further embodiments of the invention the detector means comprises a number of anchorable elongated members each constituted by a track arranged normal to the conveyor and an element movable with the conveyor along the anchored track, movement of the element along the track generating a signal indicative of the associated conveyor section advance.

In other embodiments of the invention the control means 12 actuates the advancing rams after each traverse of the mining machine is complete to straighten the conveyor. Such an embodiment would necessarily include a feature whereby the advancing rams if required could move the conveyor sections desired increments towards the goaf in order to ensure the coveyor was maintained straight.

From the above description it will be seen that the present invention provides a method of and apparatus for controlling incremental advance of the armored conveyor installed along an underground longwall working face.

I claim:

1. A method of controlling advance of an armored conveyor arranged along an underground mine longwall face having roadways adjacent to its ends, the conveyor comprising a series of articulated sections advanceable with respect to the fact in snake-like manner by a plurality of advancing mechanisms spaced along the length of the conveyor, comprising advancing the conveyor sections towards desired advance positions, detecting the advances of a plurality of said conveyor sections arranged over substantially the length of the conveyor, said detecting being done by means including a wound elongate member anchorable at one end for unwinding as the conveyor is advanced toward the longwall, the advances being indicated by signals corresponding to the unwound length of the member, comparing the summed detected advances, and controlling subsequent advances of the conveyor sections such that the relative advance of substantially the whole conveyor length tends to be maintained at the same distance from an initial base line, the straightness of the conveyor is maintained within preselected-limits and the summed advances of the conveyor sections adjacent to the ends of the conveyor are such that the angle of the substantially straight conveyor with respect to said roadways is maintained within a further preselected limit.

2. Apparatus for controlling advance of an armored conveyor arrangeable along as underground mine longwall face having roadways adjacent to its ends, the conveyor comprising a series of articulated conveyor sections advanceable with respect to the fact in snake-like manner by a plurality of advancing mechanisms spaced along the length of the conveyor, comprising detector means for detecting advances of different conveyor sections, means for producing signals indicative of the detected advances of said different conveyor sections, said detector means comprising means including a wound elongate member anchorable at one end for unwinding as the conveyor is advanced toward the wall, the indicating signals being indicative of the unwound length of the member, comparator means for comparing said signals, and control means for controlling subsequent advances of the conveyor sections such that the relative advance of substantially the whole conveyor length tends to be maintained at the same distance from an initial base line, the straightness of the conveyor is maintained within preselected limits, the signals derived from the conveyor sections adjacent to the ends of the conveyor being compared by the control means which thereby controls the relative advances of the two ends of the conveyor such that the angle of the substantially straight conveyor with respect to said roadways is maintained within a further preselected limit.

3. Apparatus according to claim 2, in which the detector means comprises a plurality of anchorable elongate members arranged for detecting the advance of each section toward the wall, the indicating signals being indicative of the advance of each conveyor section.

* * * * *